US010876475B2

(12) United States Patent
Lineton

(10) Patent No.: US 10,876,475 B2
(45) **Date of Patent: *Dec. 29, 2020**

(54) STEEL PISTON CROWN AND/OR COMBUSTION ENGINE COMPONENTS WITH DYNAMIC THERMAL INSULATION COATING AND METHOD OF MAKING AND USING SUCH A COATING

(71) Applicant: TENNECO INC., Lake Forest, IL (US)

(72) Inventor: Warran Boyd Lineton, Chelsea, MI (US)

(73) Assignee: Tenneco Inc., Lake Forest, IL (US)

( * ) Notice: Subject to any disclaimer, the term of this patent is extended or adjusted under 35 U.S.C. 154(b) by 149 days.

This patent is subject to a terminal disclaimer.

(21) Appl. No.: 15/848,763

(22) Filed: Dec. 20, 2017

(65) Prior Publication Data

US 2018/0128166 A1 May 10, 2018

Related U.S. Application Data

(63) Continuation-in-part of application No. 15/354,001, filed on Nov. 17, 2016, now Pat. No. 10,578,050.
(Continued)

(51) Int. Cl.
*F02F 3/14* (2006.01)
*F02B 77/11* (2006.01)
(Continued)

(52) U.S. Cl.
CPC ..... *F02B 77/11* (2013.01); *C23C 4/02* (2013.01); *C23C 4/073* (2016.01); *C23C 4/11* (2016.01);
(Continued)

(58) Field of Classification Search
CPC ..... F02F 3/14
See application file for complete search history.

(56) References Cited

U.S. PATENT DOCUMENTS 3,911,891 A 10/1975 Dowell
3,976,809 A 8/1976 Dowell
(Continued)

FOREIGN PATENT DOCUMENTS

JP S5484419 U 6/1979
JP H01184261 A 7/1989
(Continued)

OTHER PUBLICATIONS

International Search Report, dated Jan. 23, 2019 (PCT/US2018/057669).
(Continued)

*Primary Examiner* — F Daniel Lopez
(74) *Attorney, Agent, or Firm* — Robert L. Stearns; Dickinson Wright, PLLC

(57) ABSTRACT

A piston for an internal combustion engine is provided. The piston includes a thermal barrier coating applied to a crown formed of steel. According to one embodiment, a bond layer of a metal is applied to a combustion surface of the crown, followed by a mixed layer of metal and ceramic with a gradient structure, and then optionally a top layer of metal. The thermal barrier coating can also include a ceramic layer between the mixed layer and top layer, or as the outermost layer. The ceramic includes at least one of ceria, ceria stabilized zirconia, yttria, yttria stabilized zirconia, calcia stabilized zirconia, magnesia stabilized zirconia, and zirconia stabilized by another oxide. The thermal barrier coating is applied by thermal spray, HVOF, or wire arc spraying. The thermal barrier coating preferably has a thickness less than 200 microns and a surface roughness Ra of not greater than 3 microns.

19 Claims, 9 Drawing Sheets

Related U.S. Application Data

(60) Provisional application No. 62/578,105, filed on Oct. 27, 2017, provisional application No. 62/257,993, filed on Nov. 20, 2015.

(51) Int. Cl.

| | |
|---|---|
| ***C23C 4/131*** | (2016.01) |
| ***C23C 4/134*** | (2016.01) |
| ***C23C 4/18*** | (2006.01) |
| ***C23C 28/00*** | (2006.01) |
| ***C23C 4/129*** | (2016.01) |
| ***F02F 3/00*** | (2006.01) |
| ***F02F 3/26*** | (2006.01) |
| ***F02F 3/12*** | (2006.01) |
| ***C23C 4/02*** | (2006.01) |
| ***C23C 4/11*** | (2016.01) |
| ***C23C 4/073*** | (2016.01) |

(52) U.S. Cl.

CPC ..... *C23C 4/129* (2016.01); *C23C 4/131* (2016.01); *C23C 4/134* (2016.01); *C23C 4/18* (2013.01); *C23C 28/321* (2013.01); *C23C 28/3215* (2013.01); *C23C 28/3455* (2013.01); *C23C 28/36* (2013.01); *F02F 3/0084* (2013.01); *F02F 3/12* (2013.01); *F02F 3/14* (2013.01); *F02F 3/26* (2013.01); *C23C 28/32* (2013.01); *C23C 28/345* (2013.01); *F02F 2003/0061* (2013.01); *F05C 2251/048* (2013.01)

(56) References Cited

U.S. PATENT DOCUMENTS

| | | | | |
|---|---|---|---|---|
| 4,966,820 | A | 10/1990 | Kojima et al. | |
| 5,169,674 | A * | 12/1992 | Miller | C23C 4/02 427/367 |
| 5,236,787 | A | 8/1993 | Grassi | |
| 5,305,726 | A | 4/1994 | Scharman et al. | |
| 5,384,200 | A | 1/1995 | Giles et al. | |
| 10,578,014 | B2 * | 3/2020 | Lineton | C23C 28/3455 |
| 2007/0261663 | A1 | 11/2007 | Lineton et al. | |
| 2015/0204269 | A1 * | 7/2015 | Hiratsuka | F02B 77/11 123/193.3 |
| 2017/0145914 | A1 | 5/2017 | Lineton et al. | |
| 2017/0145952 | A1 | 5/2017 | Lineton et al. | |
| 2017/0234216 | A1 | 8/2017 | Durrett et al. | |
| 2017/0241371 | A1 | 8/2017 | Schneider | |
| 2017/0268457 | A1 | 9/2017 | Azevedo et al. | |

FOREIGN PATENT DOCUMENTS

| | | | |
|---|---|---|---|
| JP | H08501602 | A | 7/1995 |
| JP | H11124662 | A | 5/1999 |
| JP | 2000273613 | A | 10/2000 |
| JP | 20095436712 | A | 10/2009 |
| JP | 2013087721 | A | 5/2013 |
| WO | 9408069 | A | 4/1994 |
| WO | 2015-072945 | * | 5/2015 |
| WO | 2017087733 | A1 | 5/2017 |
| WO | 2017087734 | A1 | 5/2017 |
| WO | 2017160896 | A1 | 9/2017 |

OTHER PUBLICATIONS

Khor K A et al: "Plasma sprayed functionally graded thermal barrier coatings", Materials Let, Elsevier, Amsterdam, NL, vol. 38, No. 6, Mar. 1, 1999 (Mar. 1, 1999), pp. 437-444, XP004256128, ISSN: 0167-577X, DOI: 10.1016/50167-577X(98)00203-I paragraph [0002]; figure 1.

International Search Report, dated Jan. 22, 2019 (PCT/US2018/057661).

International Search Report, dated Feb. 8, 2017 (PCT/US2016/062649).

Oerlikon Metco: Thermal Spray Poweder Products: Ceria-Yttria Stabilized Zirconium Oxide HOSP Powder, Aug. 12, 2014, pp. 1-3, retrieved from the Internet Jan. 16, 2017: https://www.oerlikon.com/ecornaXL/files/oerlikon_DSMTS-0038.1_CeZrO.pdf&download=1.

Chunxu Pan et al., Microstructural characteristics in plasma sprayed functionally graded ZrO2/NiCrAl coatings, vol. 162, No. 2-3, Jan. 20, 2003, pp. 194-201 (Sections 1-3.1; Tables 1, 2).

International Search Report, dated Feb. 20, 2017 (PCT/US2016/062648).

Jalaludin Helmisyah Ahmad et al, Experimental Study of Ceramic Coated Piston Crown for Compressed Natural Gas Direct Injection Engines, Procedia Engineering, vol. 68, Nov. 18, 2013, pp. 505-511 (Sections 2.1, 3.1; Figure 2; Table 1).

M. B. Beardsley, Final Report of Thick Thermal Barrier Coatings (TTBCs) for Low Emmission, High Efficiency Diesel Engine Components, Prepared for Assistant Secretary for Energy Efficiency and Renewable Energy, Office of Transportation Technologies as part of the Ceramic Technology Project of the Materials, Development Program, under contract FC05-97OR22580, Mar. 26, 2006, 144 pages.

Ralph A. Corvino, Ceramic Coating Diesel Engine Combustion Components, 1989, pp. 43-44.

* cited by examiner

| Measured surface | T-decay half-life [s] |
|---|---|
| Anodized aluminum (on puck) | 0.012 |
| Cerakote (on aluminum piston) | 0.011 |
| Toyota SiRPA (on aluminum piston) | 0.013 |
| 0.4mm bond/mix/ceramic (on steel piston) | 0.078 |
| 0.2mm bond/mix/ceramic (on steel piston) | 0.043 |
| 0.2mm bond/mix (on steel piston) | 0.032 |
| 0.2mm bond/mix/metal (on steel piston) | 0.029 |
| 0.1mm bond/mix/ceramic (on steel piston) | 0.016 |

FIG. 8

STEEL PISTON CROWN AND/OR COMBUSTION ENGINE COMPONENTS WITH DYNAMIC THERMAL INSULATION COATING AND METHOD OF MAKING AND USING SUCH A COATING

CROSS-REFERENCE TO RELATED APPLICATION

This U.S. continuation-in part patent application claims priority to U.S. provisional patent application No. 62/578,105, filed Oct. 27, 2017 and U.S. utility patent application Ser. No. 15/354,001, filed Nov. 17, 2016, which claims priority to U.S. provisional patent application No. 62/257,993 filed Nov. 20, 2015, the contents of which are incorporated herein by reference in their entirety.

BACKGROUND OF THE INVENTION

1. Field of the Invention

This invention relates generally to engine combustion components for internal combustion engines including pistons for internal combustion engines, and methods of manufacturing the same.

2. Related Art

Modern heavy duty diesel engines are being pushed towards increased efficiency under emissions and fuel economy legislation. To achieve greater efficiency, the engines must run hotter and at higher peak pressures. Thermal losses through the combustion chamber can be problematic under these increased demands. Typically, about 4% to 6% of available fuel energy is lost as heat through the piston into the cooling system. One way to improve engine efficiency is to extract energy from hot combustion gases by turbo-compounding. For example, about 4% to 5% of fuel energy can be extracted from the hot exhaust gases by turbo-compounding.

Another approach to improving engine efficiency is to insulate the crown of the piston in order to reduce the heat otherwise lost to the cooling system. Insulating layers of ceramic are one approach to insulating the piston. It is known to apply a metal layer to the body portion of the piston followed by application of a ceramic layer. However, ceramic is inherently porous and the combustion gases can pass through the ceramic layer and oxidize the metal layer causing a failure at the ceramic/metal layer interface and eventual spalling and failure of the ceramic layer. There is also a mismatch in the thermal expansion coefficients of the ceramic and metal layer, further adding to the potential delamination and spalling of the ceramic layer over time.

Another example is a thermally sprayed coating formed of yttria stabilized zirconia. This material, when used alone, can suffer destabilization through thermal effects and chemical attack in diesel combustion engines. It has also been found that thick ceramic coatings, such as those greater than 500 microns, for example 1 mm, are prone to cracking and failure.

Although more than 40 years of thermal coating development for pistons is documented in literature, there is no known product that is both successful and cost effective to date. It has also been found that typical aerospace coatings used for jet turbines are not suitable for engine pistons because of raw material and deposition costs associated with the highly cyclical nature of the thermal stresses imposed.

Another approach to piston protection specific to aluminum pistons is to convert the surface of the aluminum crown to aluminum oxide via plasma oxidation and then the pores of the conversion layer are sealed with polysilazane. The conversion zone is very thin (50-70 microns) and is understood to be a high insulation and dissipation material that quickly heats and cools so it cycles with the heat of combustion. This relatively thin conversion approach for aluminum pistons has no application for use with steel pistons.

SUMMARY

One aspect of the invention provides a piston with an improved thermal barrier coating for use in an internal combustion engine. The piston comprises a body portion including a crown presenting a combustion surface, and the thermal barrier coating is applied to the crown. According to one embodiment, the thermal barrier coating includes a bond layer formed of metal disposed on the body portion, a mixed layer disposed on the bond layer, and a top layer disposed on the mixed layer. The mixed layer is formed of a mixture of ceramic and metal, and the top layer is formed of metal and fills pores of the ceramic of the mixed layer.

According to another embodiment, the thermal barrier coating includes a bond layer formed of metal disposed on the body portion and a mixed layer disposed on the bond layer. The mixed layer includes a mixture of ceramic and metal, and the thermal barrier coating has a thickness of not greater than 700 microns.

According to yet another embodiment, the thermal barrier coating includes a bond layer formed of metal disposed on the body portion and a mixed layer disposed on the bond layer. The mixed layer includes a mixture of ceramic and metal. In this embodiment, a ceramic layer is formed entirely of a ceramic material is disposed on the mixed layer. The ceramic layer presents an outermost exposed surface of the thermal barrier coating and has a surface roughness Ra of not greater than 3 microns, and the thermal barrier coating has a total thickness of not greater than 200 microns.

Another aspect of the invention provides a method of manufacturing a piston with an improved thermal barrier coating for use in an internal combustion engine. The method includes applying a thermal barrier coating to a combustion surface of a crown formed of metal. According to one embodiment, the step of applying the thermal barrier coating includes applying a bond layer formed of metal to the crown, applying a mixed layer formed of a mixture of ceramic and metal to the bond layer, and applying a top layer formed of metal to the mixed layer, the top layer filling pores of the ceramic of the mixed layer. In this embodiment, the mixed layer provides an outermost surface with a surface roughness Ra of not greater than 3 microns.

According to another embodiment, the step of applying the thermal barrier coating includes applying a bond layer formed of metal to the crown, and applying a mixed layer formed of a mixture of ceramic and metal to the bond layer. The thermal barrier coating has a total thickness of not greater than 700 microns.

According to yet another embodiment, the step of applying the thermal barrier coating includes applying a bond layer formed of metal to the crown, applying a mixed layer formed of a mixture of ceramic and metal to the bond layer, and applying a ceramic layer formed entirely of a ceramic material to the mixed layer. The ceramic layer presents an outermost exposed surface of the thermal barrier coating and has a surface roughness Ra of not greater than 3 microns. The thermal barrier coating has a total thickness of not greater than 200 microns.

BRIEF DESCRIPTION OF THE DRAWINGS

These and other advantages of the present invention will be readily appreciated, as the same becomes better understood by reference to the following detailed description when considered in connection with the accompanying drawings wherein:

FIG. 8 illustrates results of a test conducted to determine performance of the thermal barrier coating according to an example embodiment.

DETAILED DESCRIPTION OF EXEMPLARY EMBODIMENTS

One aspect of the invention provides an engine component, such as a piston 20, with a thermal barrier coating 22 for use in an internal combustion engine, such as a heavy duty diesel engine or alternatively a gasoline engine. The thermal barrier coating 22 reduces heat loss to the cooling system and thus improves engine efficiency. The thermal barrier coating 22 is also more cost effective and stable, as well as less susceptible to chemical attacks, compared to other coatings used to insulate pistons.

Figure 1:
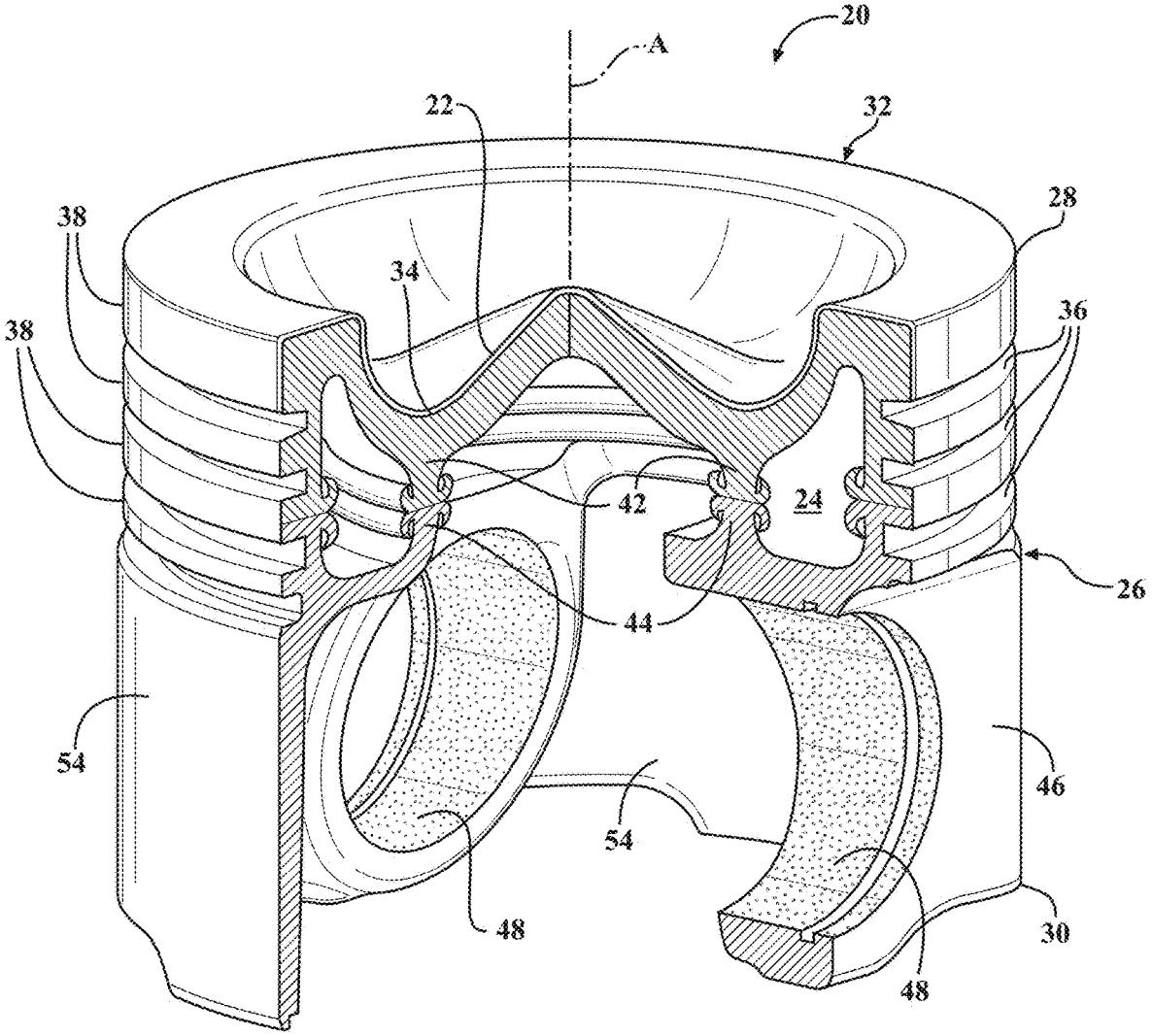
FIG. 1 is a perspective sectional view a gallery-containing diesel engine piston including a thermal barrier coating applied to the crown according to an example embodiment.

According to an example embodiment shown in FIG. 1, the thermal barrier coating 22 is applied to the piston 20. However, various different components of the internal combustion engine 20 can be coated with the thermal barrier coating 22. The example piston 20 is designed for use in a heavy duty diesel engine and exposure to combustion gases, but the thermal barrier coating 22 can be applied to other types of pistons, and also to other components exposed to a combustion chamber of an internal combustion engine. In the example embodiment, the piston 20 includes a body portion 26 formed of a metal material, preferably a ferrous material, such as steel or another iron-based material. The steel used to form the body portion 26 can be an AISI 4140 grade or a microalloy 38MnSiVS5, for example. The steel used to form the body portion 26 preferably does not include phosphate, and if any phosphate is present on the surface of the body portion 26, then that phosphate is removed prior to applying the thermal barrier coating 22. The body portion 26 extends around a center axis A and longitudinally along the center axis A from an upper end 28 to a lower end 30. The piston body portion 26 also includes a crown 32 extending circumferentially about the center axis A from the upper end 28 toward the lower end 30. In the embodiment of FIG. 1, the crown 32 is joined to the remainder of the body portion 26, in this case by welding.

The crown 32 of the piston 20 defines a combustion surface 34 at the upper end 28 which is directly exposed to hot gasses, and thus high temperatures and pressures, during use of the piston 20 in the internal combustion engine. In the example embodiment, the combustion surface 34 includes a combustion bowl extending from a planar outer rim, and the combustion surface 34 includes an apex at the center axis A. The crown 32 of the piston 20 also defines at least one ring groove 36 located at an outer diameter surface and extending circumferentially about the center axis A for receiving at least one ring (not shown). Typically the piston 20 includes two or three ring grooves 36. Ring lands 38 are disposed adjacent each ring groove 36 and space the ring grooves 36 from one another and from the combustion surface 34.

In the example of FIG. 1, the piston 20 includes a cooling gallery 24 extending circumferentially around the center axis A between the crown 32 and the remainder of the body portion 26. In this embodiment, the crown 32 includes an upper rib 42 spaced from the center axis A, and the adjacent section of the body portion 26 includes a lower rib 44 spaced from the center axis A. The upper rib 42 is welded to the lower rib 44 to form the cooling gallery 24. In this case, the ribs 42, 44 are friction welded together, but the ribs 42, 44 may be joined using other methods. The cooling gallery 24 can contain a cooling fluid to dissipate heat away from the hot crown 32 during use of the piston 20 in the internal combustion engine. In addition, cooling fluid or oil can be sprayed into the cooling gallery 24 or along an interior surface of the crown 32 to reduce the temperature of the crown 24 during use in the internal combustion engine.

As shown in FIG. 1, the body portion 26 of the piston 20 further includes a pair of pin bosses 46 spaced from one another about the center axis A and depending from the crown 32 to the lower end 30. Each pin boss 46 defines a pin bore 48 for receiving a wrist pin which can be used to connect the piston 20 to a connecting rod. The body portion 26 also includes a pair of skirt sections 54 spacing the pin bosses 46 from one another about the center axis A and depending from the crown 32 to the lower end 30.

Figure 2:
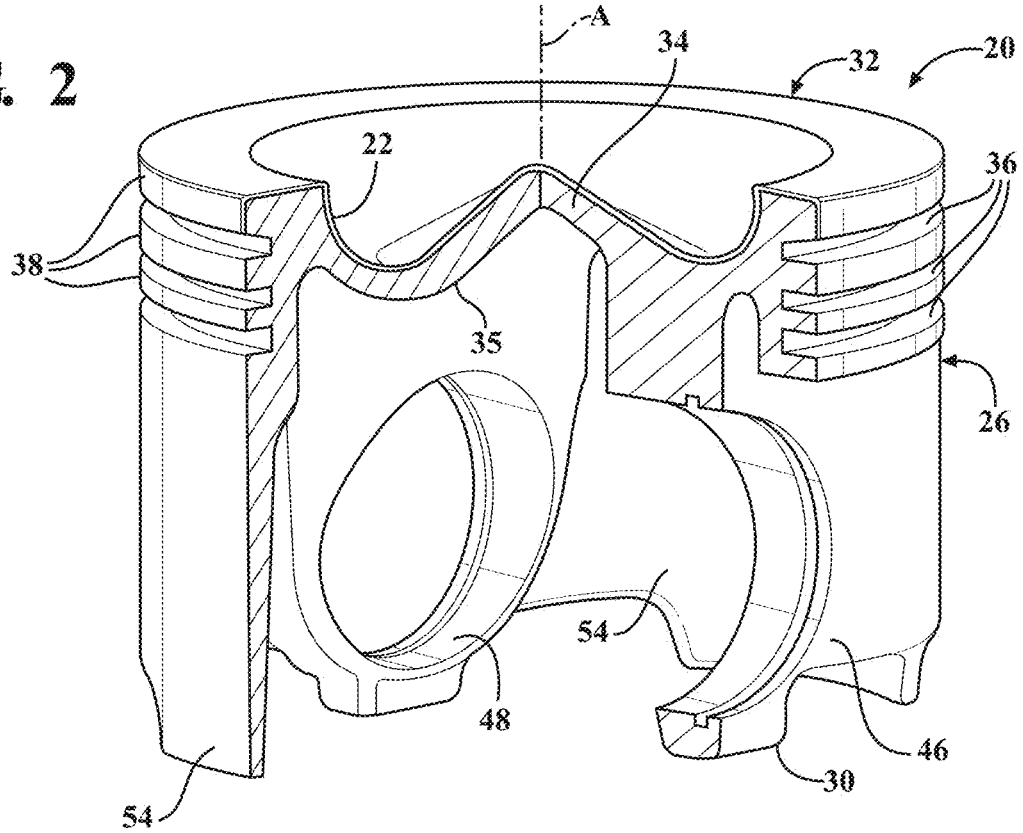
FIG. 2 is a perspective sectional view of a galleryless diesel engine piston including the thermal barrier coating applied to the crown according to another example embodiment.

According to another example embodiment shown in FIG. 2, the body portion 26 of the piston 20 is a galleryless piston. The galleryless piston 20 includes the crown 32 presenting the upper combustion surface 34 which is directly exposed to combustion gasses of a combustion chamber contained within a cylinder bore of the internal combustion engine. In the example embodiment, the combustion surface 34 includes the apex at the center axis A. The ring grooves 36 and ring lands 38 depend from the combustion surface 34 and extend circumferentially along an outer diameter of the piston 20. The galleryless piston 20 also includes the pin bosses 46 spaced from one another about the center axis A and depending from the crown 32 to the lower end 30. Each pin boss 46 defines the pin bore 48 for receiving a wrist pin which can be used to connect the piston 20 to a connecting rod. The body portion 26 also includes the skirt sections 54 spacing the pin bosses 46 from one another about the center axis A and depending from the crown 32 to the lower end 30. The entire body portion 26 of the galleryless piston 20 is typically forged or cast as a single piece.

An undercrown surface 35 of the piston 20 of FIG. 2 is formed on an underside of the crown 32, directly opposite the combustion surface 34 and radially inwardly of the ring grooves 36. The undercrown surface 35 is the surface on the direct opposite side from the combustion bowl. The undercrown surface 35 is defined here to be the surface that is visible, excluding any pin bores 48 when observing the piston 20 straight on from the bottom. The undercrown surface 35 is also openly exposed, as viewed from an underside of the piston 20, and it is not bounded by a sealed or enclosed cooling gallery.

In other words, when looking at the piston 20 from the bottom, the surface that presents itself is the undercrown surface 35 of the upper crown 32 and not, for example, a floor of a cooling gallery. Since the piston 20 is "galleryless," the bottoms of the cavities directly exposed to the undercrown surface 35 are uncovered and open from below. Unlike traditional gallery style pistons, the galleryless piston 20 lacks bottom floors or ledges that would normally serve to entrap a certain amount of cooling oil in the region or space immediately below the undercrown surface 35. The undercrown surface 35 of the present piston 20 is intentionally and fully open, and the exposure thereof is maximized.

The undercrown surface 35 of the piston 20 also has greater a total surface area (3-dimensional area following the contour of the surface) and a greater projected surface area (2-dimensional area, planar, as seen in plan view) than comparative pistons having a sealed or enclosed cooling gallery. This open region along the underside of the piston 20 provides direct access to oil splashing or being sprayed from within a crankcase directly onto the undercrown surface 35, thereby allowing the entire undercrown surface 35 to be splashed directly by oil from within the crankcase, while also allowing the oil to freely splash about the wrist pin and further, significantly reduce the weight of the piston 20. Accordingly, although not having a typical closed or partially closed cooling gallery, the generally open configuration of the galleryless piston 20 allows optimal cooling of the undercrown surface 35 and lubrication to the wrist pin within the pin bores 48, while at the same time reducing oil residence time on the surfaces near the combustion bowl, which is the time in which a volume of oil remains on the surface. The 2-dimensinional and 3-dimensional surface area of the undercrown surface 35 is typically maximized so that cooling caused by oil splashing or being sprayed upwardly from the crankcase against the exposed surface can be enhanced, thereby lending to exceptional cooling of the piston 20.

As shown in example embodiment of FIG. 1, the thermal barrier coating 22 is applied to the combustion surface 34 and at least one of the ring lands 38 of the piston 20 to reduce heat loss to the combustion chamber and thus increase efficiency of the engine. In the example embodiment, the thermal barrier coating 22 is applied to the uppermost ring land 38 directly adjacent the combustion surface 34. The thermal barrier coating 22 can also be applied to other portions of the piston 20, and optionally other steel components exposed to the combustion chamber of the internal combustion engine, such as liner surfaces, valves, and cylinder heads, in addition to the piston 20. The thermal barrier coating 22 is oftentimes disposed in a location aligned with and/or adjacent to the location of the fuel injector, fuel plumes, or patterns from heat map measurements in order to modify hot and cold regions along the crown 32.

The thermal barrier coating 22 is designed for exposure to the harsh conditions of the combustion chamber. For example, the thermal barrier coating 22 can be applied to pistons 20 for use in a diesel engine which is subject to large and oscillating thermal cycles. This type of piston 20 experiences extreme cold start temperatures and reaches up to 760° C. when in contact with combustion gases. There is also temperature cycling from each combustion event of approximately 15 to 20 times a second or more. In addition, pressure swings up to 250 to 300 bar are seen with each combustion cycle.

Figure 3:
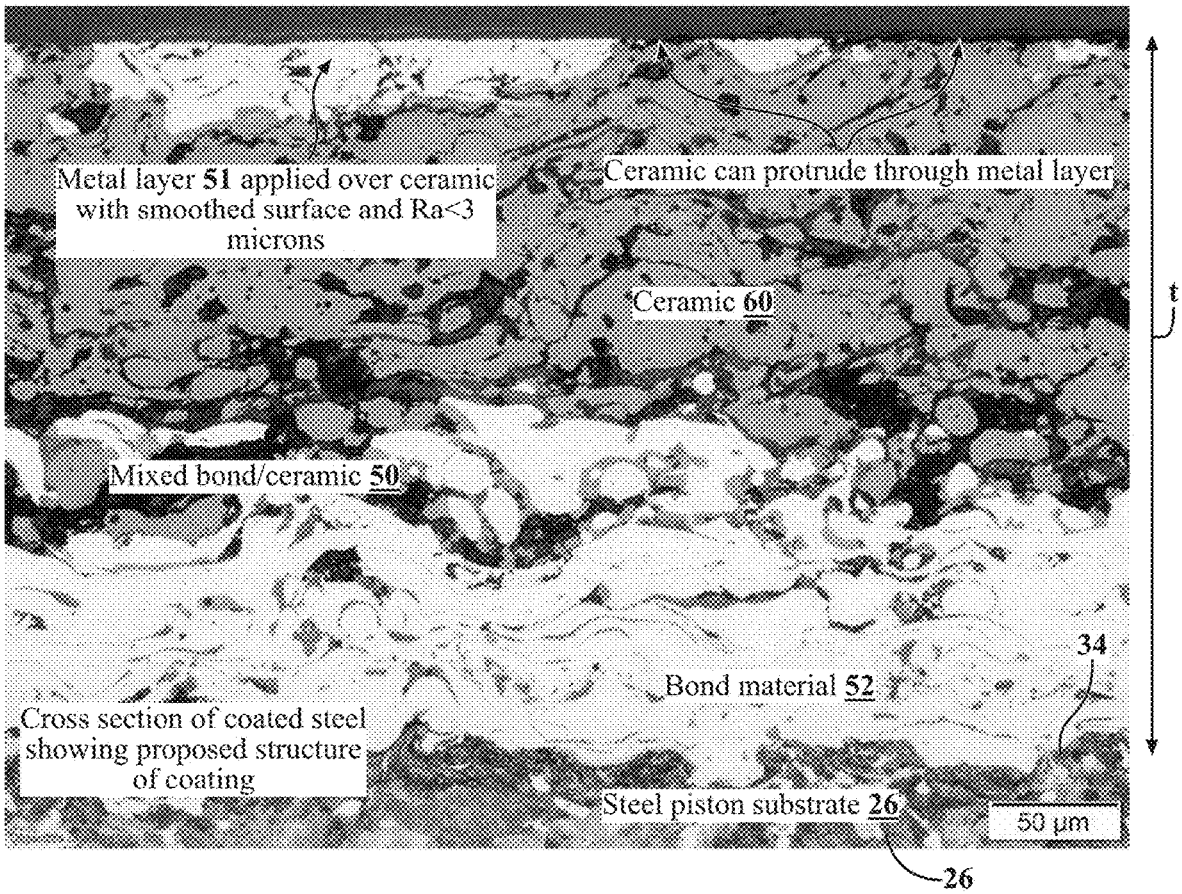
FIGS. 3-6 are cross-sectional views showing the thermal barrier coating disposed on a steel piston crown according to example embodiments.
Figure 4:
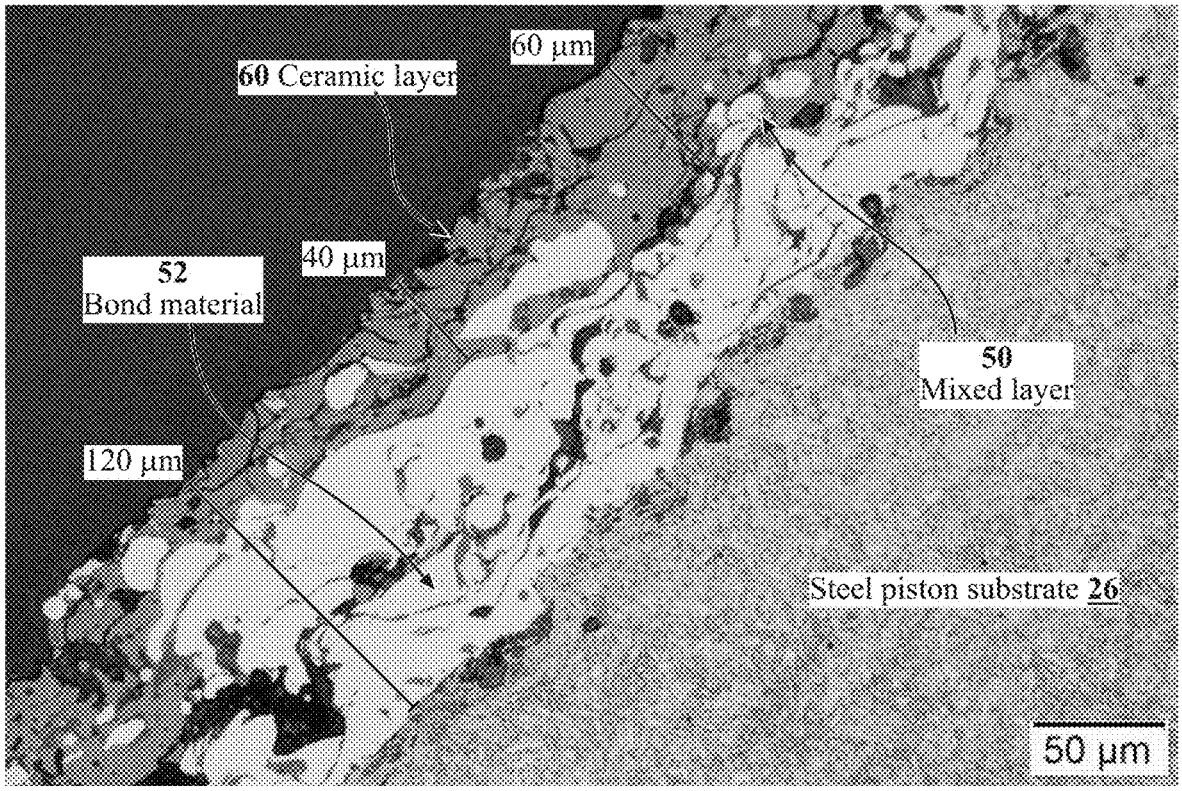
Figure 5:
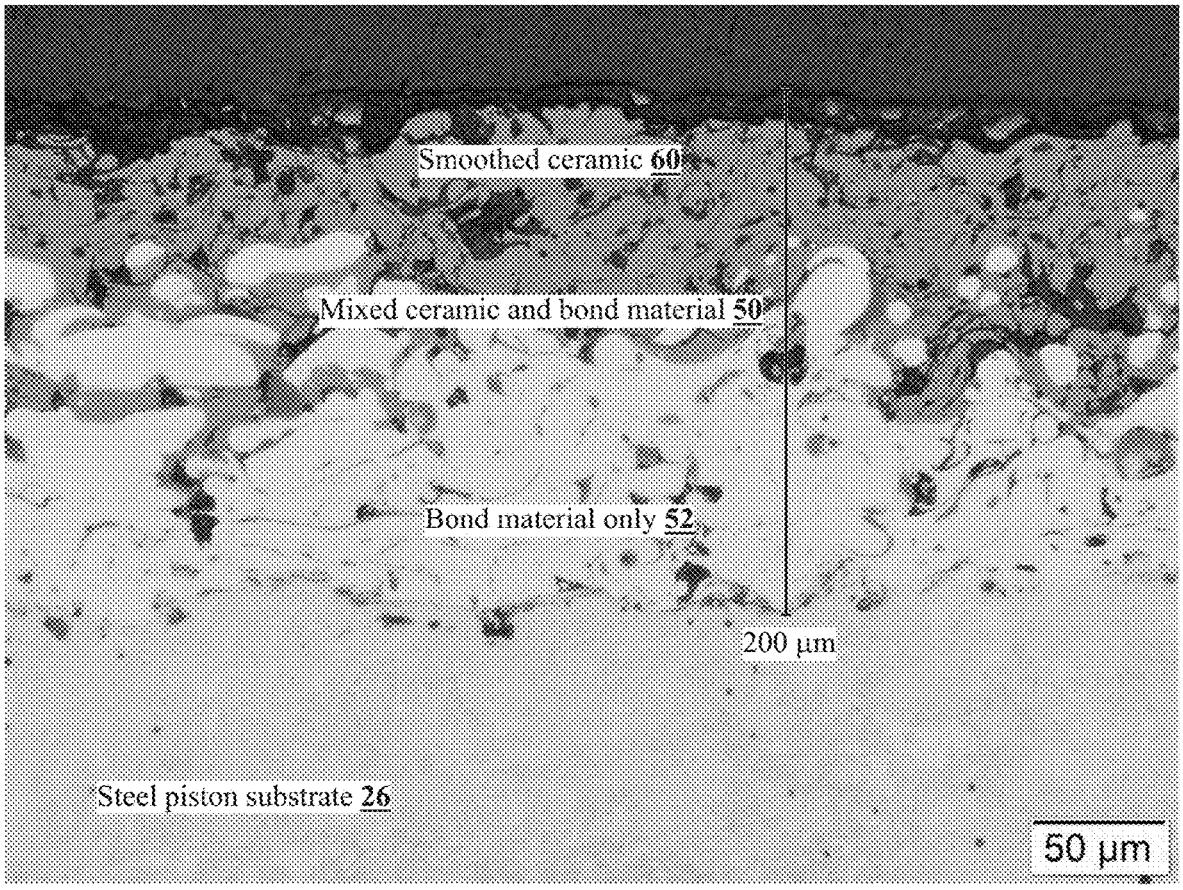
Figure 6:
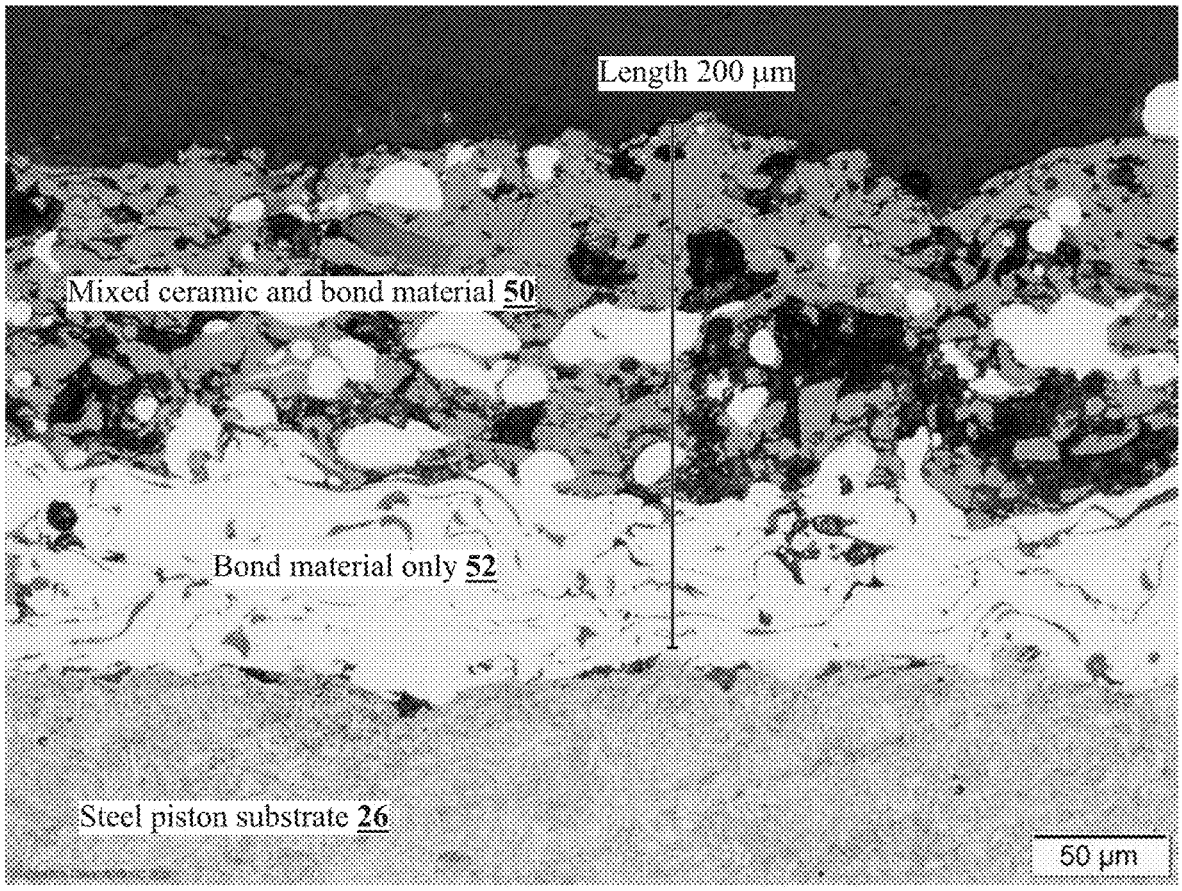
Figure 7:
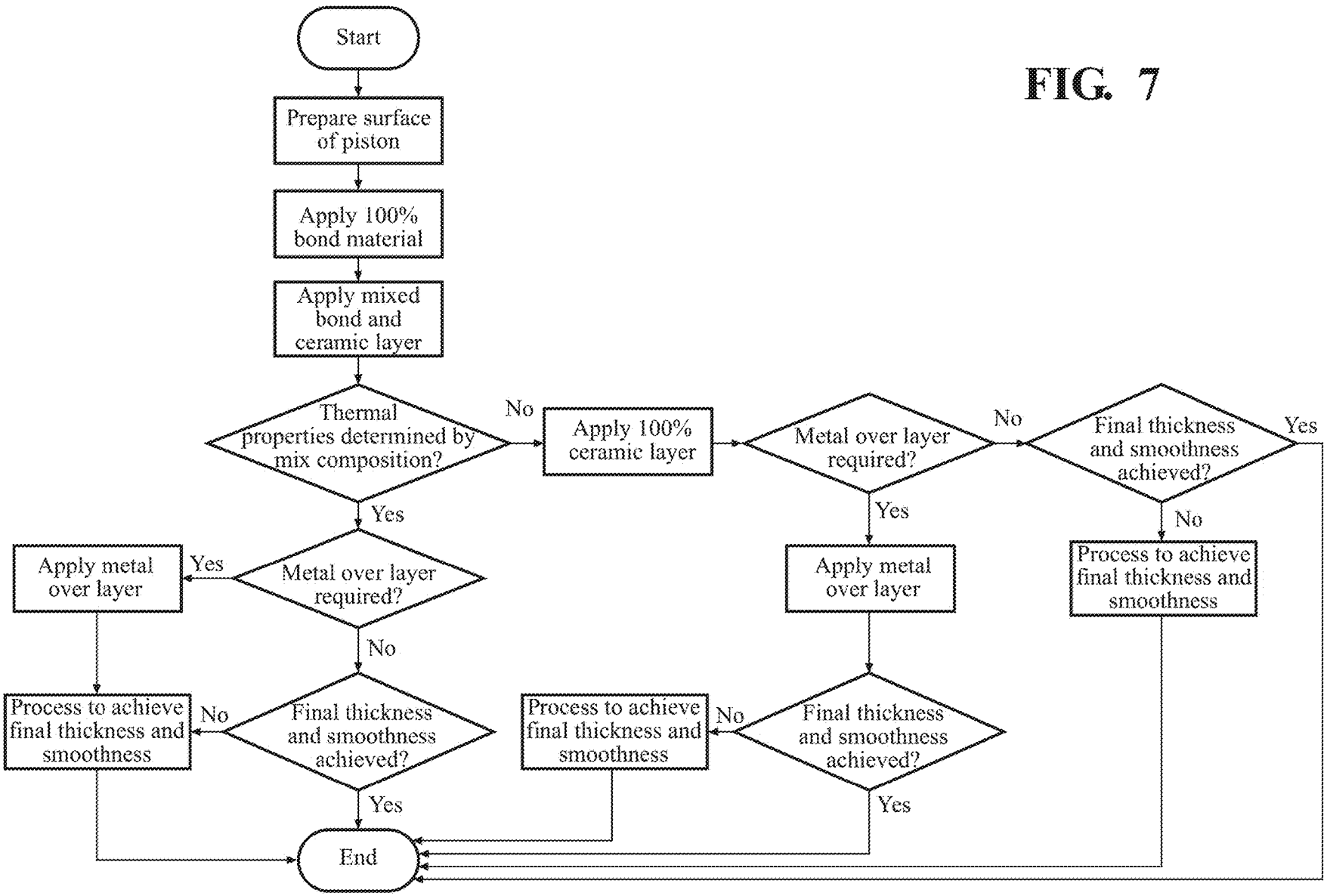
FIG. 7 is a flow chart illustrating various embodiments of the thermal barrier coating.

According to an exemplary embodiment shown in FIG. 3, the thermal barrier coating 22 includes a mixed layer 50, a top layer 51, a bond layer 52, and a ceramic layer 60. The initial bond layer 52 is applied directly to the steel surface of the piston crown 32, followed by the mixed layer 50, then the ceramic layer 60, and then the top layer 51. FIG. 4 shows another embodiment including the bond layer 52, the mixed layer 50, and the ceramic layer 60. FIG. 5 shows another exemplary embodiment including the bond layer 52, the mixed layer 50, and the ceramic layer 60. FIG. 6 shows another embodiment including the bond layer 52 and the mixed layer 50 in the as-applied condition. FIG. 7 is a flow chart illustrating various possible embodiments of the thermal barrier coating 22.

The bond layer 52 is formed of metal and achieves good adhesion to the steel body portion 26. The bond layer 52 also presents a thin but robust bond surface on which to apply the remainder of the thermal barrier coating 22. The material used to form the bond layer 52 may be the same material, or similar to, or different from the material used to form the body portion 26, for example a ferrous material, such as steel or another iron-based material. The material of the bond layer 52 is compatible with the ferrous or other material used to form the body portion 26. The material of the bond layer 52 could also be formed of chromium, nickel, and/or cobalt. The bond layer 52 could also be formed a chromium alloy, nickel alloy, and/or cobalt alloy. The body layer 52 could also be a high performance superalloy, such as a nickel-based superalloy or cobalt based superalloy. For example, the metal bond layer 52 could include or consist of at least one of alloy selected from the group consisting of CoNiCrAlY, NiCrAlY, NiCr, NiAl, NiCrAl, NiAlMo, and NiTi. According one preferred embodiment, the metal bond layer 52 is formed of NiCrAlY or NiCrAl.

The thermal barrier coating 22 typically includes the metal bond layer 52 in an amount of 5 percent by volume (% by vol.) to 33% by vol. %, more preferably 10% by vol. to 33% by vol., most preferably 20% by vol. to 33% by vol., based on the total volume of the thermal barrier coating 22. The metal bond layer 52 is provided in the form of particles having a particle size of −140 mesh (<105 μm), preferably −170 mesh (<90 μm), more preferably −200 mesh (74 μm), and most preferably −400 mesh (<37 μm). The thickness limit of the metal bond layer 52 is dictated by the particle size of the material forming the metal bond layer 52. A low thickness is oftentimes preferred to reduce the risk of delamination of the thermal barrier coating 22. The thickness of the bond layer 52 may be between 20 to 100 microns, but preferably is between 20 and 50 microns.

Prior to application of the bond layer 52, the steel surface of the piston body portion 26 is appropriately cleaned such as by grit blasting and the bond layer 52 is then deposited on to the bare surface of the piston 20 by plasma spray, high velocity oxy-fuel (HVOF), and/or wire arc. It is noted that the surface to be coated with the barrier coating 22 is preferably bare steel and is free, for example, of a phosphate coating.

Applied to the bond layer 52 is a composite or mixed layer 50 of ceramic and metal material. The metal material in the mixed layer 50 may the same, similar, or different from the candidate materials identified above for the bond layer 52. In other words, the composition of the metallic material selected for the bond layer 52 may be the same, similar, or different from that used in the mixed layer 50 of the barrier coating 22.

The ceramic material of the mixed layer 50 is typically at least one oxide, for example ceria, ceria stabilized zirconia, yttria, yttria stabilized zirconia, calcia stabilized zirconia, magnesia stabilized zirconia, zirconia stabilized by another oxide, and/or a mixture thereof. The ceramic material has a low thermal conductivity, such as less than 1 W/m·K. When ceria is used in the ceramic material, the thermal barrier coating 22 is more stable under the high temperatures, pressures, and other harsh conditions of a diesel engine. The composition of the ceramic material including ceria also makes the thermal barrier coating 22 less susceptible to chemical attack than other ceramic coatings, which can suffer destabilization when used alone through thermal effects and chemical attack in diesel combustion engines. Ceria and ceria stabilized zirconia are much more stable under such thermal and chemical conditions. Ceria has a thermal expansion coefficient which is similar to the steel material used to form the piston body portion 26. The thermal expansion coefficient of ceria at room temperature ranges from 10E-6 to 11E-6, and the thermal expansion coefficient of steel at room temperature ranges from 11E-6 to 14E-6. The similar thermal expansion coefficients help to avoid thermal mismatches that produce stress cracks.

In one embodiment, the ceramic material is present in an amount of 70 percent by volume (% by vol.) to 95% by vol., based on the total volume of the thermal barrier coating 22. In one embodiment, the ceramic material used to form the thermal barrier coating 22 includes ceria in an amount of 90 to 100 weight percent (wt. %), based on the total weight of the ceramic material. In another example embodiment, the ceramic material includes ceria stabilized zirconia in an amount of 90 to 100 wt. %, based on the total weight of the ceramic material. The ceria stabilized zirconia preferably includes ceria in an amount of 20 to 25 wt. %, based on the total weight of the ceria stabilized zirconia. In another example embodiment, the ceramic material includes yttria or yttria stabilized zirconia in an amount of 90 to 100 wt. %, based on the total weight of the ceramic material. In yet another example embodiment, the ceramic material includes ceria stabilized zirconia and yttria stabilized zirconia in a total amount of 90 to 100 wt. %, based on the total weight of the ceramic material. In another example embodiment, the ceramic material includes magnesia stabilized zirconia, calcia stabilized zirconia, and/or zirconia stabilized by another oxide in an amount of 90 to 100 wt. %, based on the total weight of the ceramic material. In other words, any of the oxides can be used alone or in combination in an amount of 90 to 100 wt. %, based on the total weight of the ceramic material. In cases where the ceramic material does not consist entirely of the ceria, ceria stabilized zirconia, yttria, yttria stabilized zirconia, magnesia stabilized zirconia, calcia stabilized zirconia, and/or zirconia stabilized by another oxide, the remaining portion of the ceramic material typically consists of other oxides and compounds such as aluminum oxide, titanium oxide, chromium oxide, silicon oxide, manganese or cobalt compounds, silicon nitride, and/or or functional materials such as pigments or catalysts. For example, according to one embodiment, a catalyst is added to the thermal barrier coating 22 to modify combustion. A color compound can also be added to the thermal barrier coating 22. According to one example embodiment, thermal barrier coating 22 is a tan color, but could be other colors, such as blue or red.

The material selection and proportions of the mixed layer 50 can be controlled to achieve a good bond with the steel body portion 26 and to tune the desired thermal characteristics of the thermal barrier coating 22. The metal material mixed in with the ceramic material also serves to protect the ceramic material (which is naturally porous) from thermal and corrosive attack from the hot combustion gases that can otherwise infiltrate and compromise the integrity of the mixed layer 50, subjecting it to delamination from the piston 20. According to a preferred embodiment, the mixed layer 50 is a 50:50 mix by weight of NiCrAlY or NiCrAl metal combined with ceria stabilized zirconia (20 wt. % ceria, 80 wt. % zirconia). Having a higher concentration of ceramic increases the insulating effect of the thermal barrier coating 22 which protects the body portion 26 of the piston 20, but too high of concentration can cause the piston 20 to retain the heat at the surface instead of cycling with the thermal transients of the combustion chamber to which it is exposed. By increasing the metal content, the pores of the ceramic material are filled and protected against attack and also the thermal barrier coating 22 becomes more thermally dynamic and its temperature at the combustion chamber surface is able to swing or cycle more closely with that of the combustion chamber environment to which it is directly exposed. The thickness/thinness of the mixed layer 50 can also play a role in the thermal properties of the thermal barrier coating 22, with thicker coatings being more insulating and thinner coatings being more dynamic in their thermal properties. According to an example embodiment, the thickness of the mixed layer 50 is 200 microns or less, or 100 microns or less, and preferably 20 to 50 microns.

According to one embodiment, the ratio of ceramic to metal material in the mixed layer 50 is a 50:50 mix by weight. More or less ceramic in the mix will increase and decrease, respectively, the thermal insulation and retention properties of the thermal barrier coating 22. The skilled artisan will understand that the ratio together with the thickness can be adjusted to tune the mixed layer 50 to achieve the desired thermal properties. For example, in the present case it is desired that the thermal barrier coating 22 sufficiently insulate the steel piston body portion 26 from thermal and oxidative damage from exposure to the environment of the combustion chamber of an internal combustion engine, and in particular a diesel engine. On the other hand, the thermal barrier coating 22 for the present case also is tuned to be sufficiently dynamic in its thermal properties to enable the thermal barrier coating 22 to cycle in sync with the transient temperature swings of the combustion cycle. In addition, these competing properties are to be achieved in the thermal barrier coating 22 that is sufficiently robust to withstand the corrosive attack of the hot combustion gases, and this is satisfied in large part by mixing the metal and ceramic in the mixed layer 50 so that the pores of the ceramic are infiltrated by the metal and the hot corrosive gases cannot penetrate the ceramic to the degree it could without the metal present which may otherwise lead to failure of the ceramic. This does not require the pores of the ceramic to be 100% filled, but rather sufficient metal to block the access of the hot gases through the surface and deep into the ceramic of the mixed layer 50. If one were to section the mixed layer 50 of a 50:50 ceramic/metal mixed layer 50, one would expect to see 20% or more of the pores of the ceramic material to contain the metal material and very few open passages extending from the surface to the base of the thermal barrier layer 22. An increase in the proportion of metal to ceramic would increase the proportion of metal seen in cross section and thus an increase in porosity fill.

According to an alternative embodiment, the mixed layer 50 of ceramic and metal and could be applied as a gradient structure whereby there would be a higher concentration of metal compared to ceramic close to the metallic bond layer 52, and progressing outward with increasing concentrations of ceramic until reaching the outer surface where the mixed layer 50 may be essentially all ceramic. For example, the gradient structure can be formed by gradually or steadily transitioning from 100% of the metal to 100% ceramic material. Alternatively, on the outer surface of the mixed layer 50, both metal and ceramic material could be present. The transition function of the gradient structure can be linear, exponential, parabolic, Gaussian, binomial, or could follow another equation relating composition average to position. The gradient structure of the mixed layer 50 helps to mitigate stress build up through thermal mismatches and reduces the tendency to form a continuous weak oxide boundary layer at the interface of the ceramic and the metal material. The gradient structure may be more compatible in some applications for the transition from steel to ceramic and may yield a more robust thermal barrier coating 22 if required for a given application. Similar dynamic temperature profiles as described above are expected from the mixed layer 50 with the gradient structure.

An outermost surface of the mixed layer 50 with the gradient structure could be polished to reveal both ceramic and metal and finished following application to achieve desired roughness. For example, a surface roughness of the mixed layer 50 with the gradient structure after spraying may have a surface roughness of Ra 10-15 microns, but can be polished to a surface roughness less than Ra 15 microns, such as 3 microns or less, and more preferably 1 micron or less.

As indicated above, an uppermost portion and/or uppermost surface of the mixed layer 50 is typically formed entirely of ceramic, but may contain both metal and ceramic. Also, the additional ceramic layer 60 formed entirely of a ceramic material can be located on top of the mixed layer 50, as shown in FIGS. 3, 4, and 5. The ceramic layer 60 could be the outermost layer and thus present the outermost exposed surface of the thermal barrier coating 22, or could be located below the metal top layer 51. This optional ceramic layer 60 can have a thickness of 20 to 80 microns. The ceramic material used to form the ceramic layer 60 can be the same or different from the ceramic of the mixed layer 50.

According to one embodiment, the thermal barrier coating 22 includes the bond layer 52, the mixed layer 50, the ceramic layer 60 disposed on the mixed layer 50, and the top layer 51 formed of metal disposed on the ceramic layer 60. The top layer 51 is smoothed to a surface roughness Ra of not greater than 3 microns, or not greater than 1 micron, or less. The top layer 51 can be abraded until some of the ceramic layer 60 is exposed or protrudes through the top layer 51, as shown in FIG. 3. Alternatively, the top layer 51 can be smoothed to provide a continuous outermost surface so that none of the ceramic layer 60 is exposed through the top layer 51.

According to another example embodiment, the thermal barrier coating 22 includes the bond layer 52, the mixed layer 50, and the ceramic layer 60 formed entirely of a ceramic material disposed on the mixed layer 50, wherein the ceramic layer 60 is an outermost exposed layer of the thermal barrier coating 22, as shown in FIGS. 4 and 5. In this case, the ceramic layer 60 is processed to a thickness of not greater than 200 microns, preferably not greater than 100 microns, and most preferably 20-80 microns. The ceramic layer 60 is also processed or smoothed to a surface roughness Ra of not greater than 5 microns, not greater than 3 microns, or less. In FIG. 4, the ceramic layer 60 is smoothed to various degrees along the surface, so that the thickness of the ceramic layer 60 is greater in some portions than others, or the ceramic layer 60 could be completed eliminated in some areas. The surface roughness and thickness of the ceramic layer 60 can be adjusted depending on how much the ceramic layer 60 is smoothed or processed. In FIG. 5, the ceramic layer 60 is smoothed to a more uniform thickness.

According to another example embodiment, the thermal barrier coating 22 includes the bond layer 52, the mixed layer 50, so that the mixed layer 50 is the outermost layer of the thermal barrier coating 22, as shown in FIG. 6. In FIG. 6, the mixed layer 50 is shown in the as-sprayed condition, before being processed or smoothed. However, the mixed layer 50 could be smoothed or processed to achieve the desired thickness and surface roughness. Also, the metal top layer 51 could be applied directly on the mixed layer 50.

When the thermal barrier coating 22 includes the top layer 51, it is typically the very outermost layer. The top layer 51 is formed of metal and is applied over the mixed ceramic/metal layer 50 and/or the ceramic layer 60 to fill the pores and seal off the surface of the ceramic. The top layer 51 is then typically polished to achieve the desired roughness. The top layer 51 is typically formed of 100 wt. % metal, based on the total weight of the top layer 51. The top layer 51 can be the same or similar material as the bond layer 52 or it can be different. For example, the material used to form the top layer 51 could be a ferrous material, such as steel or another iron-based material. The material of the top layer 51 may also be chromium, nickel, and/or cobalt. The top layer 51 could also comprise a chromium alloy, nickel alloy, and/or cobalt alloy. The top layer 51 could also be a high performance superalloy, such as a nickel-based superalloy or cobalt based superalloy. For example, the metal top layer 51 could include or consist of at least one of alloy selected from the group consisting of CoNiCrAlY, NiCrAlY, NiCr, NiAl, NiCrAl, NiAlMo, and NiTi. According to preferred embodiments, the metal top layer 51 is formed of NiCrAlY or NiCrAl, chromium, and/or chromium alloy. The top layer 51 is typically deposited on the mixed layer 50 by plasma, HVOF and/or wire arc spray. This top layer 51 can serve as a protective layer to the ceramic material.

As indicated above, the top layer 51 is optionally polished to a degree where some of the peaks of the underlying ceramic material are revealed through the metal top layer 51. Depending on the amount of abrading and the initial thickness of the top layer 51, there can be areas of the top layer 51 where peaks of the underlying ceramic material show through or the ceramic peaks can show through uniformly across all of the top layer 51. The top layer 51 may be abraded smooth to a surface roughness Ra of 3 microns or less, or even 1 micron or less. The Ra of 3 micron or less finish provides a very smooth and highly polished surface that benefits the flow and guidance of a fuel plume in the combustion bowl during the combustion cycle, and further resists carbon buildup. The thickness of the top layer 51 typically ranges from 10 to 100 microns, depending on how much material is removed during the smoothing process, and whether it is desirable to have peaks of the ceramic material exposed and showing through. According to one embodiment, no mixed layer 50 or ceramic layer 60 is exposed under the top layer 51, so that the top layer 51 provides a smooth continuous exposed surface. According to another embodiment, some of the mixed layer 50 or some of the ceramic layer 60 is exposed through the top layer 51.

The resulting outermost final surface can consist of the top layer 51, or some of the underlying ceramic material may be revealed through the abrading operation such that a mix of ceramic and metal is present at the final outermost surface. In the latter case for this embodiment, the final surface would have a majority of the metallic material with peaks or specks of the ceramic dispersed and appearing in the otherwise continuous top layer 51, and especially where there may have been more abrading than in other areas of the final surface. Visually, one would see a largely metallic final surface with specks of the ceramic dispersed either evenly throughout or more heavily in some regions than others. This can give the surface a mottled appearance with specks of the ceramic appearing in the otherwise continuous top layer 51 of metal.

It is to be understood that the various layers as-applied are not perfectly smooth and are typical of what one skilled in the art would expect when applying coating materials by plasma spray. Roughness can affect combustion by trapping fuel in cavities on the surface of the thermal barrier coating 22. It is typically desirable to avoid coated surfaces rougher than the examples described herein. Immediately after plasma spraying, the thermal barrier coating 22 preferably has a surface roughness Ra of less than 15 μm, and a surface roughness Rz of not greater than 110 μm. However, the thermal barrier coating 22 can be smoothed. The same is true if HVOF or wire arc processes are used for the deposition. The material is applied in splats and builds to develop a layering effect due to overlapping of adjacent deposits, but it is not applied smooth nor necessarily uniform. It would be typical to have a series of peaks and valleys (as seen on the micro scale) and an intermixing of materials as a subsequently applied material may come to rest in a valley of a previously applied material, and a peak of prior material may project through a layer of a subsequently applied material. The intermix effect is enhanced when subsequent abrading operations are performed to smooth the surface, wherein some of the overlying material is stripped away and some of the underlying material (especially peaks) are revealed at the abraded surface.

The total thickness of the thermal barrier layer 22 may range from 50 to 350 or 700 microns, but preferably 200 microns or less or 150 microns or less or even less than 100 microns. For example, the overall coating (bond layer 52, mixed layer 50, and top layer 51) may have a thickness of 250 microns or less, with the bond layer 52 having a thickness of 20 to 50 microns, the mixed layer 50 have a thickness of 20 to 50 microns, and the top layer 51 having a thickness of 50 to 100 microns. If the ceramic layer is present between the mixed layer 50 and the top layer 51, the ceramic layer can have a thickness of 20 to 100 microns. As stated above, according to one embodiment, the thermal barrier coating 22 includes only the bond layer 52 and the mixed layer 50 with a total thickness of 700 microns or less.

Typically, 5% to 25% of the entire thickness of the thermal barrier coating 22 is formed of the bond layer 52, and about 30% to 90% of the thermal barrier coating 22 could be made up of the mixed layer 50. If the ceramic layer is present, about 5 to 50% of the thickness could be made up of the ceramic layer.

As described above, the thermal barrier coating 22 of the example embodiment includes a smooth surface with pores filled by the top layer 51 to give similar fuel swirl characteristics as a non-coated piston surface. The thermal barrier coating 22 is not expected to absorb fuel or lubricant since the pores are filled.

The horizontal splat pattern of the top coat 51 is not expected to admit hot combustion gases because of the closed network of splats from the plasm spray. The thin ceramic-based mixed layer 50 insulates the crown 32 of the piston 20 but follows the transient temperature of the combustion, and the top layer 51 protects against hot oxidation due to the metal chemistry. The steel crown 32 of the piston 20 is thus protected from thermal and oxidative damage, while producing efficiency benefits.

When the thermal barrier coating 22 includes the bond layer 52 and the mixed layer 50, but not the top layer 51 of metal, the total thickness of the thermal barrier coating 22 of this embodiment is up to 700 microns, preferably not greater than 400 microns, such as 50 to 400 microns, and more preferably not greater than 200 microns, or not greater than 150 microns. This two-layer structure is typically plasma sprayed onto the surface of the piston 20. Complex geometries of the piston crown 32 can be coated, such as valve pockets, and combustion surfaces 34 with wavy features.

According to one embodiment, the bond layer 52 of the thermal barrier coating 22 is applied to the body portion 26 of the piston 20 after grit blasting the surface. There is preferably no phosphate coating or other material applied to the surface of the piston 20 prior to applying the bond layer 52. Preferably, the bond layer 52 is applied by a plasma spray, to an average thickness of 50 to 100 microns, but may be applied using one of the other methods discussed herein. The material of the bond layer 52 of this embodiment may be the same as those described above with regard to the first example embodiment. Typically, the bond layer 52 is formed of chromium, nickel, cobalt, or an alloy thereof, or a nickel based superalloy or cobalt based superalloy. Preferably, the bond layer 52 is formed of NiCrAlY or NiCrAl.

The mixed layer 50 may be applied directly on the bond layer 52, typically by plasma spraying. There are no sharp interfaces in the thermal barrier coating 22, and thus thermal stress concentration is avoided. The mixed layer 50 of this embodiment can include the same ceramic materials and metal materials discussed above with regard to the first example embodiment. For example, the metal can be the same material used to form the bond layer 52, such as chromium, nickel, cobalt, alloy thereof, nickel based superalloy, or cobalt based superalloy. The ceramic can be at least one oxide, for example ceria, ceria stabilized zirconia, yttria, yttria stabilized zirconia, calcia stabilized zirconia, magnesia stabilized zirconia, zirconia stabilized by another oxide, and/or a mixture thereof. The composition of the mixed layer 50 can be varied to tune the thermal properties. The mixed layer 50 can vary from 10 wt. % to 90 wt. % ceramic material, based on the total weight of the mixed layer 50, and the remainder is formed of the metal material, such as one of the metal materials used to form the bond layer 52 described above. In this embodiment, the mixed layer 50 could be applied as the gradient structure discussed above. Typically, the uppermost portion of the mixed layer 50 is formed entirely of the ceramic material. Optionally, the ceramic layer could be applied to the mixed layer 50, as discussed above.

The mixed layer 50 can have a thickness of 50 to 350 microns, such that the total thickness is less than 700 microns, for example between 100 to 450 microns, with a preferred total thickness of about 200 microns or less. No other coatings of metal or ceramic are applied on top of the mixed layer 50 in this embodiment, such that the thermal barrier layer 22 is a two-layer structure. The sprayed roughness of the mixed layer 50 is about Ra 10-15 microns, but the outermost surface of the mixed layer 50 can be abraded as described above to smooth the surface to have an Ra of 3 microns or less if desired.

A preferred example composition the mixed layer 50 is a 50:50 mix by volume of NiCrAlY or NiCrAl combined with ceria stabilized zirconia (20 wt. % ceria, 80 wt. % zirconia). The bond layer 52 is also preferably the NiCrAlY or NiCrAl superalloy. Also, a preferred total thickness of the thermal barrier layer 20 is about 200 microns, with the bond layer 52 having a thickness of 50 to 100 microns, and the remaining length is the mixed layer 50.

The thermal barrier coating 22 provides numerous advantages, including good thermal protection of the steel body portion 26. The thermal barrier coating 22 has a low thermal conductivity to reduce heat flow through the thermal barrier coating 22. Typically, the thermal conductivity of the thermal barrier coating 22 having a thickness of less than 1 mm is less than 1.00 W/m.K, preferably less than 0.5 W/m.K, and most preferably not greater than 0.23 W/m.K. The specific heat capacity of the thermal barrier coating 22 depends on the specific composition used, but typically ranges from 480 J/kg.K to 610 J/kg.K at temperatures between 40 and 700° C. The low thermal conductivity of the thermal barrier coating 22 is achieved by the porosity of the ceramic material 50. Due to the composition and low thermal conductivity of the thermal barrier coating 22, the thickness of the thermal barrier coating 22 can be reduced relative to comparative coatings, which reduces the risk of cracks or spalling, while achieving the same level of insulation relative to comparative coatings of greater thickness. It is noted that the advantageous low thermal conductivity of the thermal barrier coating 22 is not expected. When the ceramic material 50 of the thermal barrier coating 22 includes ceria stabilized zirconia, the thermal conductivity is especially low.

Various evaluations and tests have been conducted to evaluate the characteristics and performance of the thermal barrier coating 22. For example, thermal imaging was used as a rapid (<1s) way to estimate the speed of cooling of the thermal barrier coating 22 on the piston 20. The thermal barrier coating 22 has also demonstrated to be very capable of cycling with the temperature of the combustion cycle. One way the dynamic cycling capability of the thermal barrier coating 22 was evaluated was to measure the rate at which the coated combustion surface 34 of the piston crown 32 cooled (thermal decay) when exposed to a heating/cooling cycle.

Tests were performed on a piston 20 including a body portion 26 formed of AISI 4140 with a bond layer 52 formed of NiCrAlY, a mixed layer 50 formed of 50:50 by weight of mixed NiCrAlY and ceria stabilized zirconia, and a ceramic material 51 formed of 100% ceria stabilized zirconia as the final exposed layer. Competitive coatings on aluminum substrates were tested for comparative purposes. Total coating thicknesses between 70 microns and 390 microns were tested. In addition, tests were done on an AISI 4140 piston body portion 26 with a two layer thermal barrier coating 22 containing a NiCrAlY bond layer 52 with a mixed layer 50 formed of 50:50 by weight layer of NiCrAlY and ceria stabilized zirconia, such that the total coating thickness was not more than 200 microns.

One approach was to expose the coated combustion surface 34 of the sample piston 20 to a heat source, remove the heat source and monitor the temperature drop at the surface as a function of time. The heat source may be a lamp flash, and thermal imaging with a FLIR camera may be used to measure the change in temperature values as a function of time after the lamp is cycled off. In this case, the lamp flashes then frames are recorded at 60 Hz while cooling.

The test included evaluating the average thermal decay time of the thermal barrier coating 22 of the example embodiment on the crown 32 of the steel piston 20, and the results are shown in FIG. 8. This assessment of thermal decay included determining how fast the coated combustion surface 34 dropped to half of its starting temperature. Using the same lamp flash cycling and sample piston 20, the coated combustion bowl surface 34 was heated to about 100° C. and the lamp cycled off. Using thermal imaging, the temperature of the coated combustion surface 34 averaged over a line from the outer diameter to the center axis A of the piston 20 was measured. FIG. 8 compares the time taken by variants of thermal barrier coatings to drop to half after the lamp flashes and delivers thermal energy to the coated piston surface.

The above temperature cycling profiles of the coated piston 20 demonstrate that the average thermal decay time of the coated piston 20 can be tuned to be close to that of the average decay time of the combustion gases that are seen by the piston 20 during a combustion cycle in an internal combustion engine. The thermal barrier coating 22 thus protects the steel piston 20 against damage corrosive and thermal damage while providing a very thermally dynamic surface that is able to swing with the rapid temperature rise and fall of combustion.

Another advantage when the thermal barrier coating 22 includes the gradient structure is that the bond strength of the thermal barrier coating 22 is increased due to the gradient structure 50 and the composition of the metal used to form the body of the piston 20. The bond strength of the thermal barrier coating 22 having a thickness of 0.38 mm is typically at least 2000 psi when tested according to ASTM C633.

The thermal barrier coating 22 with mixed layer 50 can be compared to a comparative coating having a two layer structure, which is typically less successful than the thermal barrier coating 22 with the mixed layer 50. The comparative coating includes a metal bond layer applied to a metal substrate followed by a ceramic layer with discrete interfaces through the coating. In this case, combustion gases can pass through the porous ceramic layer and can begin to oxidize the bond layer at the ceramic/bond layer interface. The oxidation causes a weak boundary layer to form, which harms the performance of the coating.

In addition to applying the thermal barrier coating 22 to the combustion surface 34, the thermal barrier coating 22 is optionally disposed on the ring lands 38 of the piston 20 to provide a reduction in heat flow through the piston 20. The reduction in heat flow is at least 50%, relative to the same piston without the thermal barrier coating 22 on the combustion surface 34 or ring lands 38. By reducing heat flow through the piston 20, more heat is retained in the exhaust gas produced by the engine, which leads to improved engine efficiency and performance.

The thermal barrier coating 22 of the present invention has been found to adhere well to the steel piston body portion 26. However, for additional mechanical anchoring, the surfaces of the piston 20 to which the thermal barrier coating 22 is applied is typically free of any edge or feature having a radius of less than 0.1 mm. In other words, the surfaces of the piston 20 to which the thermal barrier coating 22 is preferably free of any sharp edges or corners.

Figure 9:
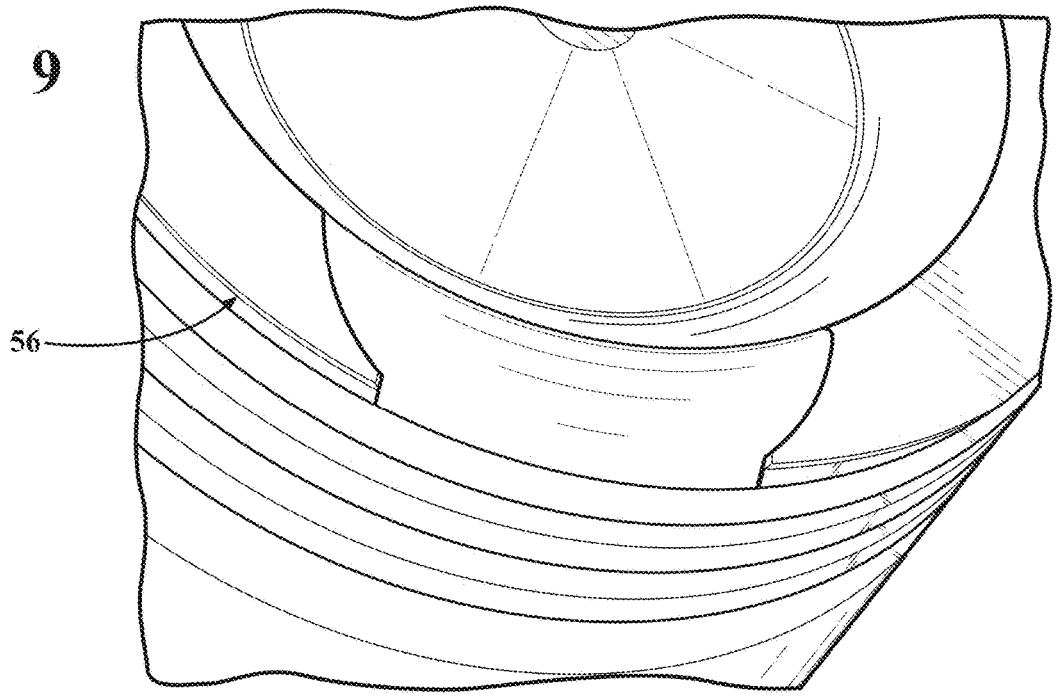
FIGS. 9 and 10 illustrate a portion of a piston crown including a chamfer along an outer diameter surface according to an example embodiment.
Figure 10:
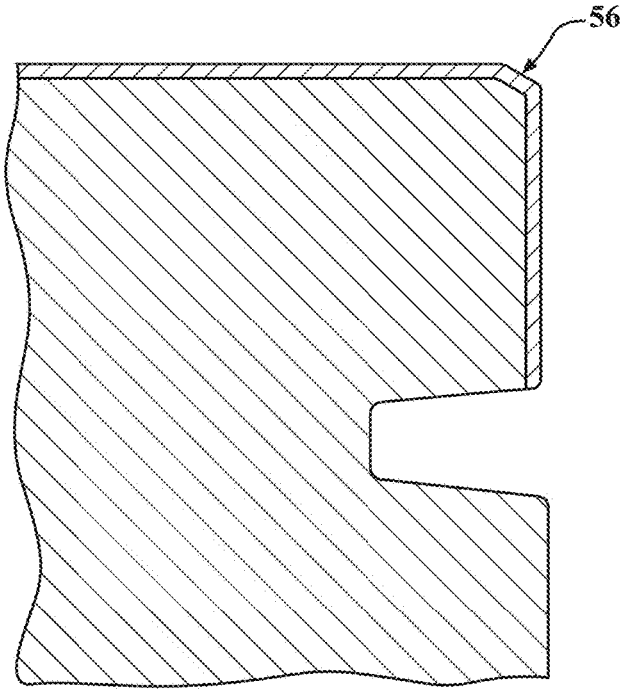

According to one example embodiment, the piston 20 includes a broken edge or chamfer 56 machined along an outer diameter surface of the crown 32, between the combustion surface 34 and the uppermost ring land 38, as shown in FIGS. 9 and 10. The chamfer 56 allows the thermal barrier coating 22 to creep over the edge of the combustion surface 34 and radially lock to the crown 32 of the piston 20. Alternatively, at least one pocket, recess, or round edge could be machined along the combustion surface 34 and/or ring lands 38 of the piston crown 32. These features help to avoid stress concentrations in the thermal sprayed coating 22 and avoid sharp corners or edges that could cause coating failure. The machined pockets or recesses also mechanically lock the thermal barrier coating 22 in place, again reducing the probability of delamination failure.

The thermal barrier coating 22 can be applied to one or more other components exposed to the combustion chamber of the engine, including a cylinder liner, cylinder head, fuel injector, valve seat, and valve face. Typically, the thermal barrier coating 22 is only applied to a portion of the component exposed to the combustion chamber. For example, an entire surface of the component exposed to the combustion chamber could be coated. Alternatively, only a portion of the surface of the component exposed to the combustion chamber is coated. The thermal barrier coating 22 could also be applied to select locations of the surface exposed to the combustion chamber, depending on the conditions of the combustion chamber and location of the surface relative to other components. In an example embodiment, the thermal barrier coating 22 is only applied to a portion of an inner diameter surface of a cylinder liner located opposite a top land of the piston 20 when the piston 20 is located at top dead center, and the thermal barrier coating 22 is not located at any other location along the inner diameter surface, and is not located at any contact surfaces of the cylinder liner.

Another aspect of the invention provides a method of manufacturing the coated piston 20 for use in the internal combustion engine, for example a diesel engine. The piston body portion 26, which is typically formed of steel, can be manufactured according to various different methods, such as forging or casting. The method can also include welding the piston crown 32 to the lower section of the piston body portion 26. As discussed above, the piston 20 can comprise various different designs. Prior to applying the thermal barrier coating 22 to the body portion 26, any phosphate or other material located on the surface to which the thermal barrier coating 22 is applied must be removed.

The method next includes applying the thermal barrier coating 22 to the piston 20. The thermal barrier coating 22 can be applied to the entire combustion surface 34 of the piston 20, or only a portion of the combustion surface 34. The ceramic material 50 and metal bond material 52 are provided in the form of particles or powders. The particles can be hollow spheres, spray dried, spray dried and sintered, sol-gel, fused, and/or crushed. In addition to the combustion surface 34, or as an alternative, the thermal barrier coating 22 can be applied to the ring lands 38, or a portion of the ring lands 38. In the example embodiment, the method includes applying the metal bond material 52 and the ceramic material 50 by a thermal or kinetic method. According to one embodiment, a thermal spray technique, such as plasma spraying, flame spraying, or wire arc spraying, is used to form the thermal barrier coating 22. High velocity oxy-fuel (HVOF) spraying is a preferred example of a kinetic method that gives a denser coating. Other methods of applying the thermal barrier coating 22 to the piston 20 can also be used. For example, the thermal barrier coating 22 could be applied by a vacuum method, such as physical vapor deposition or chemical vapor deposition. According to one embodiment, HVOF is used to apply a dense layer of the metal bond material 52 to the crown 32, and a thermal spray technique, such as plasma spray, is used to apply the mixed layer 50. Also, the mixed layer 50 can be applied by changing feed rates of twin powder feeders while the plasma sprayed coating is being applied.

The example method begins by spraying the metal used to form the bond layer 52 in an amount of 100 wt. % and the ceramic used to form the mixed layer 50 in an amount of 0 wt. %, based on the total weight of the materials being sprayed. Once the bond layer 52 is formed, the method includes spraying a mixture of the ceramic and metal to form the mixed layer 50. To form the gradient structure, throughout the spraying process, an increasing amount of ceramic material can be added to the composition, while the amount of metal bond material is reduced. Thus, the composition of the thermal barrier coating 22 gradually changes from 100% metal bond material 52 at the piston body portion 26 to 100% ceramic material 50 at an outermost surface, which may or may not be an exposed surface 58. Multiple powder feeders are typically used to apply the thermal barrier coating 22, and their feed rates are adjusted to achieve the desired structure. When the mixed layer 50 includes the gradient structure, the gradient structure is achieved during the thermal spray process. To form the thermal barrier coating 22 of the first example embodiment, the method includes applying the top layer 51 on the mixed layer 50, typically depositing by plasma, HVOF and/or wire arc spray.

The thermal barrier coating 22 can be applied to the entire combustion surface 34 and ring lands 38, or a portion thereof. Non-coated regions of the body portion 26 can be masked during the step of applying the thermal barrier coating 22. The mask can be a re-usable and removal material applied adjacent the region being coated. Masking can also be used to introduce graphics in the thermal barrier coating 22. In addition, after the thermal barrier coating 22 is applied, the coating edges are blended, and sharp corners or edges are reduced to avoid high stress regions.

The thermal barrier coating 22 has a thickness t extending from the combustion surface 34 to the exposed surface 58, as shown in FIG. 3. According to example embodiments, the thermal barrier coating 22 is applied to a total thickness t of not greater than 1.0 mm, and preferably not greater than 200 microns. The thickness t can be uniform along the entire surface of the piston 20, but typically the thickness t varies along the surface of the piston 20. In certain regions of the piston 20, for example where a shadow from a plasma gun is located, the thickness t of the thermal barrier coating 22 can be lower. In other regions of the piston 20, for example at the apex of the combustion surface 34 or regions which are in line with and/or adjacent to fuel injectors, the thickness t of the thermal barrier coating 22 is increased. For example, the method can include aligning the piston body portion 26 in a specific location relative to the fuel plumes by fixing the piston body portion 26 to prevent rotation, using a scanning gun in a line, and varying the speed of the spray or other technique used to apply the thermal barrier coating 22 to adjust the thickness t of the thermal barrier coating 22 over different regions of the piston body portion 26.

In addition, more than one layer of the thermal barrier coating 22 having the same or different compositions, could be applied to the piston 20. Furthermore, coatings having other compositions could be applied to the piston 20 in addition to the thermal barrier coating 22.

Prior to applying the thermal barrier coating 22, the surface of the piston crown 32 is washed in solvent to remove contamination. Next, the method typically includes removing any edge or feature having a radius of less than 0.1 mm. The method can also include forming the broken edges or chamfer 56, or another feature that aids in mechanical locking of the thermal barrier coating 22 to the piston body portion 26 and reduce stress risers, in the piston crown 32. These features can be formed by machining, for example by turning, milling or any other appropriate means. The method can also include grit blasting surfaces of the piston body portion 26 prior to applying the thermal barrier coating 22 to improve adhesion of the thermal barrier coating 22.

After the thermal barrier coating 22 is applied to the piston body portion 26, the coated piston 20 can be abraded to remove asperities and achieve a smooth surface. The method can also include forming a marking on the surface of the thermal barrier coating 22 for the purposes of identification of the coated piston 20 when the piston 20 is used in the market. The step of forming the marking typically involves re-melting the thermal barrier coating 22 with a laser. According to other embodiments, an additional layer of graphite, thermal paint, or polymer is applied over the thermal barrier coating 22. If the polymer coating is used, the polymer burns off during use of the piston 20 in the engine. The method can include additional assembly steps, such as washing and drying, adding rust preventative and also packaging. Any post-treatment of the coated piston 20 must be compatible with the thermal barrier coating 22.

The resultant overall thermal barrier coating 22 presents a thermal barrier for ferrous components exposed to combustion gases and the cycle of an internal combustion engine, and is able to readily cycle with the temperature of the intake and combustion gases better than a thicker ceramic coating. The metal top layer 51 seals the coating against attack from the corrosive fuel environment that can sometimes penetrate and compromise thermal barrier coatings. The application technique of the top layer 51 (e.g., plasma spray) is believed to be particularly effective at shielding the top layer 51 and mixed layer 50 against attack from the hot corrosive environment. The applied metal top layer 51 has a close network of horizontally spreading splats of the metal material that resists absorption of fuel since they do not present vertical boundaries of the metal top layer 51 that would be present if for example the top layer 51 were applied by electrodeposition and that are more prone to absorption and attack by the combustion gasses and fuel. The smoothness of the abraded top layer 51 presents a surface that is comparable to an uncoated piston and allows the piston 20 to perform in fuel plume management to the level of an uncoated piston and much better than a ceramic coated piston alone.

Obviously, many modifications and variations of the present invention are possible in light of the above teachings and may be practiced otherwise than as specifically described while within the scope of the following claims. In particular, all features of all claims and of all embodiments can be combined with each other, as long as they do not contradict each other.

The invention claimed is:

1. A piston, comprising:

a body portion formed of metal;

said body portion including a crown presenting a combustion surface;

a thermal harrier coating applied to said crown;

said thermal barrier coating including a bond layer formed of metal disposed on said body portion, said bond layer having a thickness of 20 to 50 microns, a mixed layer disposed on said bond layer, said mixed layer having a thickness of 20 to 50 microns, and a top layer disposed on said mixed layer, said top layer having a thickness of 50 to 100 microns;

said mixed layer formed of a mixture of ceramic and metal; and said top layer formed of metal and filling pores of said ceramic of said mixed layer.

2. The piston of claim 1, wherein said top layer has a surface roughness Ra of not greater than 3 microns.

3. The piston of claim 1, wherein said thermal barrier coating has a thickness of not greater than 700 microns.

4. The piston of claim 1, wherein said mixed layer has a gradient structure, the gradient structure including an increasing concentration of said ceramic material moving from said bond layer to said top layer.

5. The piston of claim 1, wherein said bond layer is formed of NiCrAlY, said metal of said mixed layer is NiCrAlY, said ceramic of said mixed layer is ceria stabilized zirconia, and said top layer is NiCrAlY.

6. The piston of claim 1, wherein said combustion surface includes at least one wavy feature and/or valve pocket, and said thermal barrier coating is, applied to said at least one wavy feature and/or valve pocket.

7. The piston of claim 1, wherein said bond layer is formed of at least one of chromium, nickel, cobalt, chromium alloy, nickel alloy, cobalt alloy, nickel based superalloy, and cobalt based superalloy;

said ceramic of said mixed layer is formed of at least one of ceria, ceria stabilized zirconia, yttria, yttria stabilized zirconia, calcia stabilized zirconia, magnesia stabilized zirconia, and zirconia stabilized by another oxide;

said metal of said mixed layer is formed of at least one of chromium, nickel, cobalt, chromium alloy, nickel alloy, cobalt alloy, nickel based superalloy, and cobalt based superalloy; and said top layer includes at least one, of chromium, nickel, cobalt, chromium alloy, nickel alloy, cobalt alloy, nickel based superalloy, and cobalt based superalloy.

8. A piston comprising:

a body portion formed of metal;

said body portion including a crown presenting a combustion surface;

a thermal barrier coating applied to said crown;

said thermal barrier coating including a bond layer formed of metal disposed on said body portion and a nixed layer disposed on said bond layer;

said mixed layer including a mixture of ceramic and metal;

said thermal barrier coating including a ceramic layer formed entirely ceramic material disposed on said mixed layer;

said thermal barrier coating including a top layer formed of metal disposed on said ceramic layer, said top layer having a surface roughness Ra of not greater than 3 microns, and wherein some of said ceramic layer is exposed through said top layer.

9. The piston of claim 8, wherein said mixed layer has a surface roughness Ra of 3 microns or less, and said thermal harrier coating has a thickness of not greater than 200 microns.

10. The piston of claim 8, wherein said bond layer is formed of NiCrAlY, said metal of said mixed layer is NiCrAlY and said ceramic of said mixed layer is ceria stabilized zirconia.

11. The piston of claim 8, wherein said metal of said bond layer and/or said metal of said mixed layer of formed of NiCrAl.

12. The piston of claim 8, wherein said bond layer has a thickness 50 to 100 microns and said mixed layer has a thickness of 50 to 350 microns.

13. The piston of claim 8, wherein said top layer has a surface roughness of not greater than 1 micron.

14. The piston of claim 8, wherein said thermal barrier coating has a thickness of not greater than 700 microns.

15. A piston, comprising:

a body portion formed of metal;

said body portion including a crown presenting a combustion surface;

a thermal barrier coating applied to said crown;

said thermal barrier coating including a bond layer formed of metal disposed on said body portion and a mixed layer disposed on said bond layer;

said mixed layer including mixture of ceramic and metal;

said thermal barrier coating including a ceramic layer formed entirely of a ceramic material disposed on said mixed layer, wherein said ceramic layer is an outermost exposed layer of said thermal barrier coating, and said ceramic layer has a thickness of not greater than 100 microns.

16. The piston of claim 15, wherein said ceramic layer has a surface roughness Ra of not greater than 5 microns.

17. The piston of claim 16, wherein said ceramic layer has a surface roughness Ra of not greater than 3 microns.

18. The piston of claim 15, wherein said thermal barrier coating has a thickness of not greater than 700 microns.

19. A piston, comprising:

a body portion formed of metal;

said body portion including a crown presenting a combustion surface;

a thermal barrier coating applied to said crown;

said thermal harrier coating including a bond layer formed of metal disposed on said body portion and a mixed layer disposed on said bond layer, said mixed layer including a mixture of ceramic and metal;

a ceramic layer formed entirely of a ceramic material disposed on said mixed layer;

said ceramic layer presenting an outermost exposed surface of said thermal barrier coating and having a surface roughness Ra of not greater than 3 microns; and said thermal barrier coating having a total thickness of not greater than 200 microns.

* * * * *